US006895938B2

(12) United States Patent
Maier

(10) Patent No.: US 6,895,938 B2
(45) Date of Patent: May 24, 2005

(54) FUEL INJECTION VALVE FOR INTERNAL COMBUSTION ENGINES

(75) Inventor: Sieghart Maier, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/466,210

(22) PCT Filed: Jul. 17, 2002

(86) PCT No.: PCT/DE02/02611

§ 371 (c)(1),
(2), (4) Date: Dec. 15, 2003

(87) PCT Pub. No.: WO03/046366

PCT Pub. Date: Jun. 5, 2003

(65) Prior Publication Data

US 2004/0104284 A1 Jun. 3, 2004

(30) Foreign Application Priority Data

Nov. 13, 2001 (DE) ..... 101 55 679

(51) Int. Cl.[7] ..... F02M 41/00
(52) U.S. Cl. ..... 123/467; 239/533.2
(58) Field of Search ..... 123/467, 478; 239/533.2, 533.6, 533.11

(56) References Cited

U.S. PATENT DOCUMENTS 4,565,320 A * 1/1986 Taniguchi et al. ..... 239/90
5,160,178 A 11/1992 Iwabuchi
6,085,991 A * 7/2000 Sturman ..... 239/88
6,152,113 A * 11/2000 Yi ..... 123/499

FOREIGN PATENT DOCUMENTS

| | | |
|---|---|---|
| DE | 42 14 646 | 11/1993 |
| DE | 42 18 943 | 12/1993 |
| DE | 199 13 679 | 9/1999 |
| DE | 100 17 112 A | 10/2001 |
| DE | 100 17 113 A | 10/2001 |

* cited by examiner

*Primary Examiner*—Mahmoud Gimie
(74) *Attorney, Agent, or Firm*—Ronald E. Greigg

(57) ABSTRACT

A fuel injection valve for internal combustion engines, having a housing having first and second bodies, which contact one another at least indirectly, each by a respective contact face and are pressed against one another by a screw sleeve. With a female thread the screw sleeve engages a male thread of the first body and with a pressure face the screw sleeve rests on a contact face of the second body, and the screw sleeve is embodied at least approximately cylindrically and surrounds the two bodies in the region of the contact faces. The screw sleeve, on its outer jacket face and over a majority of its length, has an outer contour that can be engaged by a screwing tool, so that with the screwing tool, a tangential force can be exerted on the screw sleeve.

11 Claims, 2 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 02/02611 filed on Jul. 17, 2002.

BACKGROUND OF THE INVENTION

1. Field of the Invention

The invention is directed to an improved fuel injection valve for internal combustion engines.

2. Description of the Prior Art

One fuel injection valve known for instance from German patent disclosure DE 199 41 930 A1 has a housing that includes a first and a second body; the first body is embodied as a valve holding body, and the second body is embodied as a valve body. Both bodies have a contact face with which they rest on one another, either directly or with the interposition of a shim. To brace the valve holding body against the valve body, a screw sleeve is provided, which surrounds both the valve body and the valve holding body and optionally also the shim in the region of the contact faces. The screw sleeve has a female thread, with which it engages a male thread embodied on the valve holding body. A pressure face is also embodied on the screw sleeve, and with it the screw sleeve rests on a contact face of the second body, or in other words of the valve body. The screw sleeve is embodied essentially cylindrically, and screwing it into the male thread of the valve holding body generates an axial force by which the valve holding body is pressed against the valve body.

To introduce a torque into the screw sleeve, a hexagon is created by grinding on its end toward the combustion chamber, so that the turning tool, such as an open-end wrench, can engage the faces of this hexagon in order to exert a suitable torque on the screw sleeve. However, the torque is introduced only via individual introduction lines, each with different torques. At relatively high torques, considerable torsion on the screw sleeve may occur under some circumstances, causing fluctuations in the torque at the thread and thus also fluctuations in the axial force with which the first body is pressed against the second body. Since in many fuel injection valves, high fuel pressure is carried through a conduit that penetrates the contact faces, leaks at the contact faces are consequently possible.

SUMMARY AND ADVANTAGES OF THE INVENTION

The fuel injection valve of the invention has the advantage over the prior art that the torque is introduced into the screw sleeve virtually uniformly, and independently of frictional factors and dimensions. To that end, the torque is introduced by the turning tool over a majority of the outer jacket face of the screw sleeve. The screw sleeve cannot twist as it is being screwed in, and the axial forces are distributed uniformly over the circumference. A uniform pressure per unit of surface area is exerted on the contact faces of the two bodies, thereby improving the leakproofness at the contact faces. The outer jacket face of the screw sleeve, over a majority of its length, has an outer contour that can be engaged by the appropriate screwing or torquing tool. As a result, a tangential force with which the screw sleeve can be screwed onto the male thread of the first body can be exerted by the screwing tool.

In an advantageous feature of the subject of the invention, the outer contour of the screw sleeve extends both over the portion of the screw sleeve that is located above the first body and over the portion of the screw sleeve that is located above the second body. As a result, the torque can be brought to bear on the screw sleeve without causing twisting of the screw sleeve between the first and second body.

In another advantageous feature, the outer contour has longitudinal grooves that are parallel to one another and that extend at least approximately parallel to the longitudinal axis of the screw sleeve. Such grooves are easy and inexpensive to make in the outer jacket face of the screw sleeve, and suitable tools that engage such grooves are also easy to produce. It is especially advantageous here to embody the outer contour in the form of a knurled contour, and in particular to make the knurled contour from parallel longitudinal grooves that have a triangular cross section and adjoin one another directly. This creates so many faces which can be engaged by the appropriate screwing tool that the torque can be introduced as uniformly as possible over the entire circumference of the screw sleeve.

BRIEF DESCRIPTION OF THE DRAWINGS

In another advantageous feature, the outer contour is formed on the outer jacket face of the screw sleeve by means of flat ground faces. It is especially advantageous to make six flat ground faces, so that in cross section of the screw sleeve the result is an outline in the shape of a regular hexagon. It is equally advantageous to provide more than six flat ground faces on the outer jacket face of the screw sleeve, which are likewise distributed uniformly over the circumference.

Further advantages and advantageous features of the subject of the invention can be learned from the description contained herein below, taken in conjunction with the drawings, in which.

DESCRIPTION OF THE PREFERRED EMBODIMENTS

Figure 1:
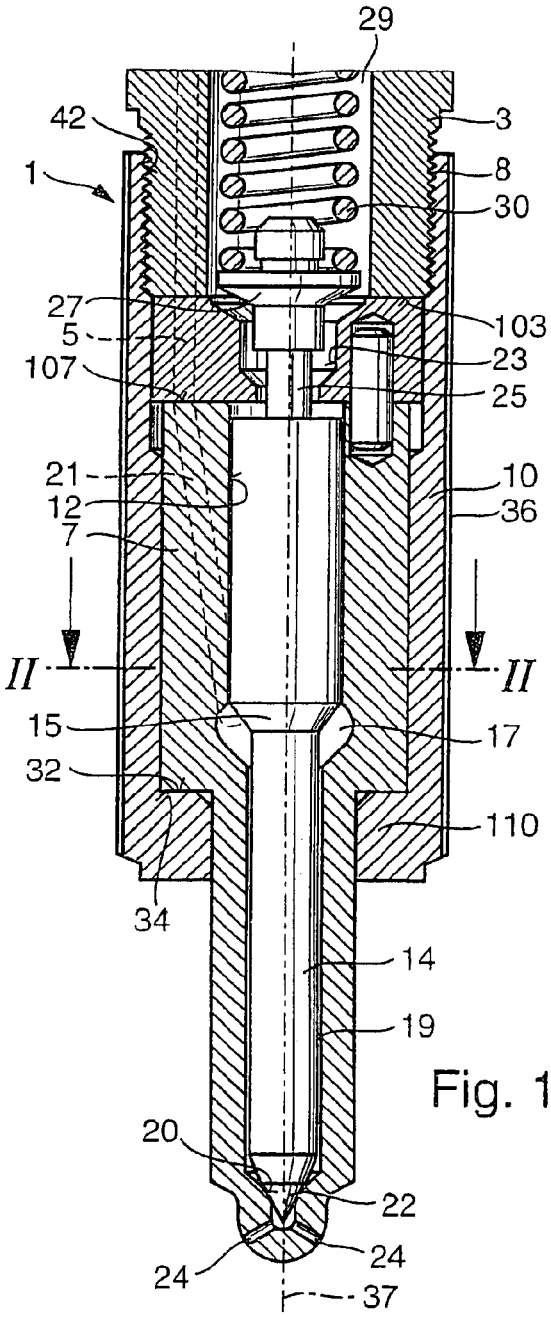
FIG. 1, is a longitudinal section through a fuel injection valve of the invention.

In FIG. 1, a longitudinal section through a fuel injection valve of the invention is shown. The fuel injection valve has a housing 1, which includes a first body 3 and a second body 7; a shim 5 is disposed between the two bodies 3, 7. The first body is embodied as a valve holding body 3, and the second body is embodied as a valve body 7. The valve holding body 3 rests with a contact face 103 on the shim 5, and the valve body 7 rests with a contact face 107 on the opposite side of the shim 5. A bore 12, embodied as a blind bore, is embodied in the valve body 7, and its end toward the combustion chamber is formed by an essentially conical valve seat 20.

On the side of the valve seat 20 remote from the combustion chamber, a plurality of injection openings are embodied in the valve body 7; they establish the communication with the combustion chamber of the internal combustion engine. A pistonlike valve needle 14 is disposed in the bore 12 and is guided sealingly in the bore 12 in a portion remote from the combustion chamber. The valve needle 14 tapers toward the combustion chamber, forming a pressure shoulder 15, and on its end toward the combustion chamber, it merges with a valve sealing face 22, which cooperates with the valve seat 20. By means of a radial enlargement of the bore 12, a pressure chamber 17 is formed at the level of the pressure shoulder 15; the pressure chamber communicates with the valve seat 20 via an annular conduit 19 surrounding the valve needle 14. The pressure chamber 17 can be filled with fuel at high pressure via a high-pressure conduit 21, extending in the valve body 7, not in the sectional plane shown, and through the shim 5 and the valve holding body 3 as far as a high-pressure connection of the fuel injection valve.

The shim 5 has a central opening 23, in which there is a thrust piece 25 that rests on the valve needle 14 and merges, remote from the valve needle 14, with a spring plate 27. The spring plate 27 protrudes into a spring chamber 29, embodied as a bore in the valve holding body 3 and extending coaxially with the bore 12. A closing spring 30 is disposed with prestressing for compression in the spring chamber 29 and is braced toward the combustion chamber on the spring plate 27 and remote from the combustion chamber on a stationary face of the valve holding body 3. Because the closing spring 30 is prestressed for compression, an axial force on the valve needle 14 results that presses the valve sealing face 22 against the valve seat 20. The pressure in the pressure chamber 17 results in a hydraulic force on the pressure shoulder 15 and on parts of the valve sealing face 22. If these hydraulic forces exceed the force of the closing spring 30, the valve needle 14 moves in the axial direction and lifts the valve sealing face 22 away from the valve seat 20, so that fuel can flow out of the pressure chamber 17 via the annular conduit 19 to the injection openings 24. If the force conditions are reversed, the valve needle 14 is kept in contact with the valve seat 20, and no fuel can emerge from the injection openings 24.

To keep the valve holding body 3, shim 5 and valve body 7 in a defined position relative to one another and to press them together so that leaks will not occur at the passage of the high-pressure conduit 21 through the contact faces 103, 107, a screw sleeve 10 is disposed on the housing 1. The screw sleeve 10 is embodied essentially hollow-cylindrically and has a longitudinal axis 37. In the region of its end remote from the combustion chamber, there is a female thread 42, with which it is screwed onto a male thread 8 on the valve holding body 3. On its end toward the combustion chamber, the screw sleeve 10 has an inward-protruding collar 110, on which an annular pressure face 32 is formed which rests on a likewise annular contact face 34 on the valve body 7. Rotating the screw sleeve 10 causes the screw sleeve 10 to move in the axial direction, because of the threads 42 and 8, thereby pressing the pressure face 32 against the contact face 34. As a result, the valve body 7 is pressed with the contact face 107 against the shim 5, and the shim 5 is pressed in turn against the contact face 103 of the valve holding body 3.

Figure 2:
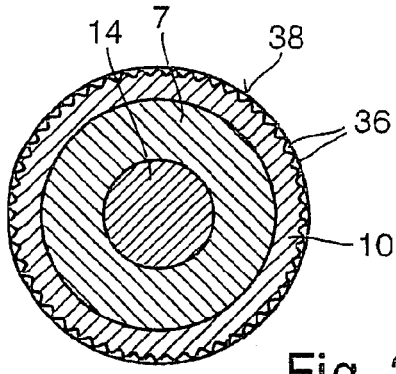
FIG. 2, a cross section through FIG. 1 taken along the line II—II.

FIG. 2 shows a cross section through the fuel injection valve of FIG. 1 along the line II—II. A knurled contour 36 is embodied in the outer region of the screw sleeve 10 and forms the outer contour of the screw sleeve 10. The knurled contour 36 here comprises longitudinal grooves 38, which are parallel to one another and have a triangular cross section and adjoin one another directly. The depth of the longitudinal grooves 38 is only a fraction of the thickness of the jacket of the screw sleeve 10, so no substantial weakening of the screw sleeve 10 occurs. The longitudinal grooves 38 here are embodied parallel to the longitudinal axis 37 of the screw sleeve 10.

Figure 3:
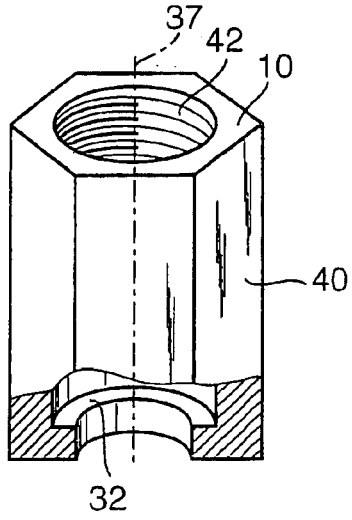
FIG. 3, a further screw sleeve, shown partly in section.

In FIG. 3, a further exemplary embodiment of the screw sleeve 10 of the invention is shown. The screw sleeve 10 is shown here in section in the lower region, that is, the region toward the combustion chamber. The outer contour of the screw sleeve 10 is embodied this time by flat ground faces 40; six flat ground faces 40 are distributed uniformly over the circumference of the screw sleeve 10, resulting in an outline in cross section equivalent to, a regular hexagon. With a suitable screwing or torquing tool that grasps the screw sleeve 10 over its entire length and correspondingly rests on all the flat ground faces 40, the torque can be introduced over the entire length of the screw sleeve 10.

Both in the embodiment of longitudinal grooves 38 and in that of flat ground faces 40, it is always provided that this feature extends over at least a majority of the length of the screw sleeve 10. It is especially advantageous if the longitudinal grooves 38 or the flat ground faces 40 extend at least approximately over the entire length of the screw sleeve 10, so that the torque can also be introduced accordingly over approximately the entire length of the screw sleeve 10.

It can also be provided that, analogously to the exemplary embodiment shown in FIG. 3, more than six flat ground faces 40 are distributed over the circumference of the screw sleeve 10, for instance eight, ten or twelve such flat ground faces. These ground faces are preferably uniformly distributed over the circumference of the screw sleeve 10, so that in cross section the result is a regular polygon at the outline.

It can also be provided that on the outer jacket face of the screw sleeve 10 there is an outer contour in which the various indentations are distributed over a majority of the length of the screw sleeve and over its entire circumference. With a suitable screwing tool that engages these indentations, a suitable torque can thus be introduced. In this case the indentations can be embodied as bores, grooves, or other pocketlike indentations.

Figure 4:
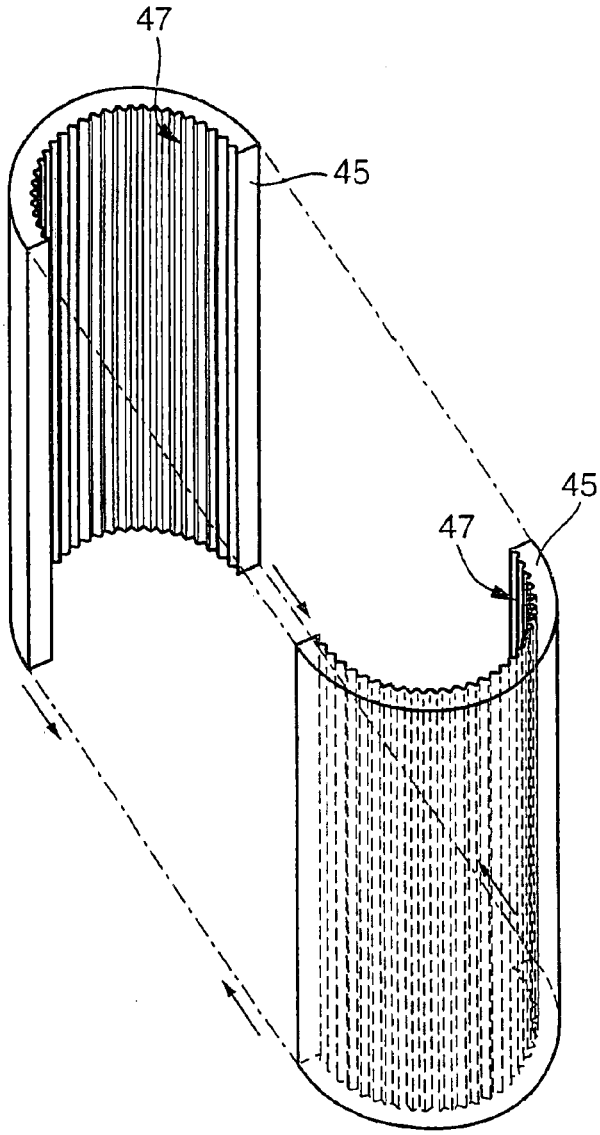
FIG. 4, a perspective view of a screwing tool for screwing a screw sleeve of the invention.

In FIG. 4, a suitable screwing tool is shown, in terms of its essential parts. The screwing tool has two clamping jaws 45, each essentially corresponding to half of a hollow cylinder. The inside of the clamping jaws 45 has a knurled contour 47, whose nature is such that it can engage the knurled contour 38 of the screw sleeve 10. By a device not shown in the drawing, the two clamping jaws 45 are pressed against one another here in the direction indicated by the arrow, so that the knurled contour 47 on the clamping jaws 45 cannot slip on the knurled contour 36 of the screw sleeve 10. In a differently shaped knurled contour 36 on the clamping sleeve 10, the knurled contour 47 of the clamping jaws 45 must be adapted accordingly, so that in that case as well, secure intermeshing is effected between the screwing tool and the clamping sleeve 10.

The foregoing relates to preferred exemplary embodiments of the invention, it being understood that other variants and embodiments thereof are possible within the spirit and scope of the invention, the latter being defined by the appended claims.

What is claimed is:

1. In a fuel injection valve for internal combustion engines, having a housing (1) that has a first body (3) and a second body (7), which contact one another at least indirectly, each by a respective contact face (103; 107) and are pressed against one another by a screw sleeve (10), and with a female thread (42) the screw sleeve (10) engages a male thread (8) of the first body (3) and with a pressure face (32) the screw sleeve rests on a contact face (34) of the second body (7), and the screw sleeve (10) is embodied at least approximately cylindrically and surrounds the two bodies (3; 7) in the region of the contact faces (103; 107), the improvement comprising an outer contour on the outer jacket face and over a majority of the length of the screw sleeve (10) that can be engaged by a screwing tool with which a tangential force can be exerted on the screw sleeve (10).

2. The fuel injection valve of claim 1, wherein the outer contour is embodied both in the portion of the screw sleeve (10) that is located above the first body (3) and on the portion of the screw sleeve (10) that is located above the second body (7).

3. The fuel injection valve of claim 1, wherein the outer contour extends at least approximately over the entire length of the screw sleeve (10).

4. The fuel injection valve of claim 2, wherein the outer contour extends at least approximately over the entire length of the screw sleeve (10).

5. The fuel injection valve of claim 1, wherein the outer contour comprises longitudinal grooves (38) that are parallel to one another and that extend at least approximately parallel to the longitudinal axis (37) of the screw sleeve (10).

6. The fuel injection valve of claim 1, wherein the contour is a knurled contour (36).

7. The fuel injection valve of claim 6, wherein the knurled contour (36) comprises parallel longitudinal grooves (38), which have a triangular cross section and adjoin one another directly.

8. The fuel injection valve of claim 1, wherein the outer contour on the outer jacket face of the screw sleeve (10) is in the form of flat ground faces (40).

9. The fuel injection valve of claim 8, wherein in cross section the screw sleeve (10) has a hexagonal outline.

10. A screwing tool for screwing a screw sleeve (10) of claim 1, the tool comprising two clamping jaws (45), which are essentially equivalent to a hollow cylinder split longitudinally in two and which on their inside have a contour that is substantially complementary to and capable of engaging the outer contour of the screw sleeve (10).

11. The screw tool of claim 10, wherein the contour on the inside of the clamping jaws (45) is a knurled contour (47).

* * * * *

UNITED STATES PATENT AND TRADEMARK OFFICE

CERTIFICATE OF CORRECTION

PATENT NO. : 6,895,938 B2
DATED : May 24, 2005
INVENTOR(S) : Sieghart Maier

It is certified that error appears in the above-identified patent and that said Letters Patent is hereby corrected as shown below:

Title page,
Item [56], References Cited, FOREIGN PATENT DOCUMENTS, should read as follows:

| | | | |
|---|---|---|---|
| -- DE | 42 14 646 | | 11/1993 |
| DE | 42 18 943 | | 12/1993 |
| DE | 44 32 686 | | 5/1996 |
| DE | 199 13 679 | | 9/1999 |
| DE | 100 17 112 | A | 10/2001 |
| DE | 100 17 113 | A | 10/2001 -- |

Signed and Sealed this

Twelfth Day of July, 2005

JON W. DUDAS
*Director of the United States Patent and Trademark Office*